US005912816A

United States Patent [19]

Emery

[11] Patent Number: 5,912,816

[45] **Date of Patent: *Jun. 15, 1999**

[54] METHOD AND APPARATUS TO ALIGN KNITTING NEEDLES AND GUIDES

[75] Inventor: Nathan Brooks Emery, Spartanburg, S.C.

[73] Assignee: Milliken & Company, Spartanburg, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/919,484

[22] Filed: Aug. 28, 1997

Related U.S. Application Data

[63] Continuation of application No. 08/409,274, Mar. 23, 1995, abandoned.

[51] Int. Cl.[6] ..... G06F 19/00

[52] U.S. Cl. ..... 364/470.14; 364/470.12

[58] Field of Search ..... 364/470.12, 470.01, 364/470.14; 66/207

[56] References Cited

U.S. PATENT DOCUMENTS

| | | | |
|---|---|---|---|
| 3,950,942 | 4/1976 | Namura et al. | 66/86 C |
| 4,019,036 | 4/1977 | Hiramatsu et al. | 235/151.1 |
| 4,027,982 | 6/1977 | Ohishi | 356/237 |
| 4,212,031 | 7/1980 | Schmitt et al. | 358/101 |
| 4,481,533 | 11/1984 | Alzmann et al. | 358/101 |
| 4,614,095 | 9/1986 | Porat | 66/207 |
| 4,711,101 | 12/1987 | Goller et al. | 66/64 |
| 4,748,568 | 5/1988 | Tobler | 364/470.01 |
| 4,755,782 | 7/1988 | Yamamoto | 335/230 |
| 4,942,538 | 7/1990 | Yuan et al. | 364/513 |
| 4,984,896 | 1/1991 | Flamig | 356/429 |
| 5,016,183 | 5/1991 | Shyong | 364/470 |
| 5,125,035 | 6/1992 | McCarthy et al. | 382/8 |
| 5,151,863 | 9/1992 | Komuro et al. | 364/470 |
| 5,333,208 | 7/1994 | Massen | 382/8 |

*Primary Examiner*—William Grant
*Assistant Examiner*—Steven R. Garland
*Attorney, Agent, or Firm*—Terry T. Moyer; George M. Fisher

[57] ABSTRACT

An apparatus and method for knitting needle and guide alignment for consistently and accurately aligning knitting needles and other knitting elements on warp knitting machines. This includes checking for needle spacing, needle height, guide spacing, guide height, and needle to guide interference. This may also check back-to-front needle and guide alignment. This system includes a video camera for acquiring an image of the knitting elements and a means of displaying this image on an electronic display. There is a linear actuator with associated control system for accurately positioning the video camera to accomplish the above tasks

15 Claims, 6 Drawing Sheets

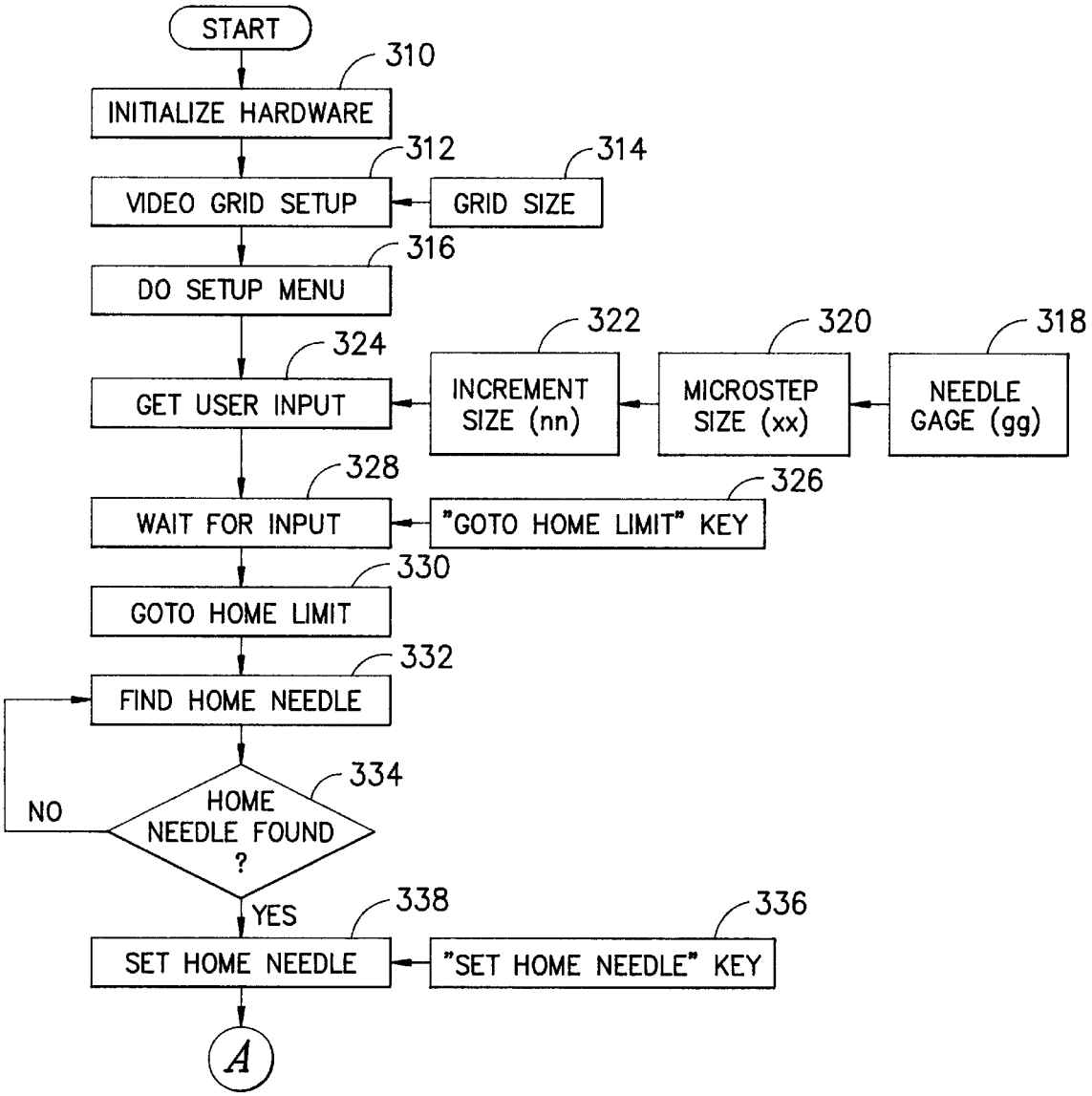
*FIG. —7—*

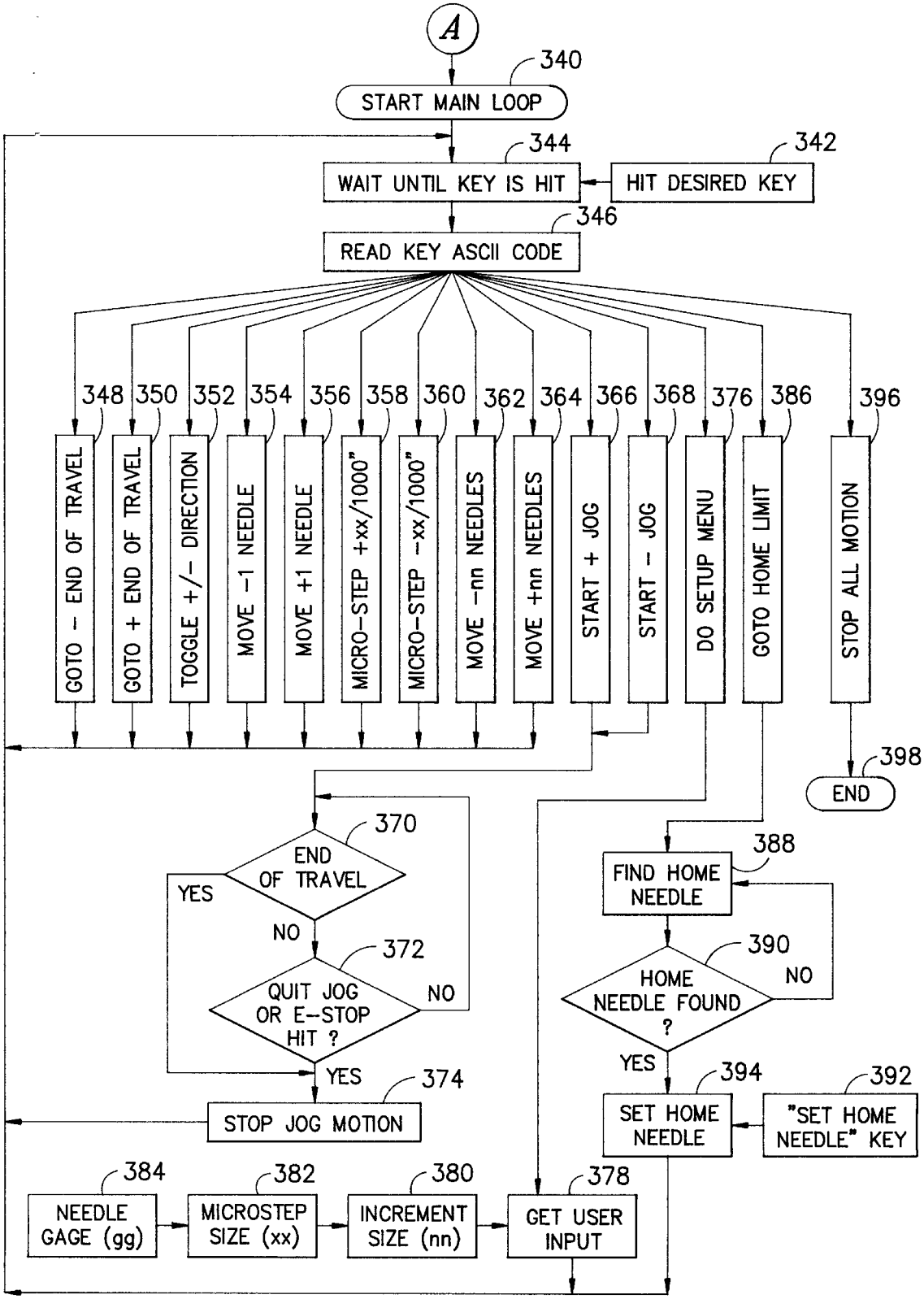
*FIG. –8–*

METHOD AND APPARATUS TO ALIGN KNITTING NEEDLES AND GUIDES

This application is a continuation of prior application Ser. No. 08/409,274, filed on Mar. 23,1995, now abandoned.

BACKGROUND OF THE INVENTION

This invention relates to a method and apparatus for consistently and accurately aligning knitting needles and other knitting elements on warp knitting machines. Traditionally, skilled technicians are needed to check knitting needle spacing, knitting needle height, knitting guide spacing, knitting guide height, and needle to guide interference as well as back-to-front guide and needle alignment. This is a very painstaking process in which the knitting machine technician was forced to visually estimate these parameters. This alignment took a considerable period of time and was very inaccurate. This inaccuracy results in significant quality problems.

This present invention solves these problems in a manner not disclosed in the known prior art.

SUMMARY OF THE INVENTION

An apparatus and method for knitting needle and guide alignment which provides a means for consistently and accurately aligning knitting needles and other knitting elements on warp knitting machines. This includes checking for needle spacing, needle height, guide spacing, guide height, and needle to guide interference. This may also check back-to-front needle and guide alignment. This system includes a video camera for acquiring an image of the knitting elements and a means of displaying this image on an electronic display. There is a linear actuator with associated control system for accurately positioning the video camera to accomplish the above tasks.

An advantage of this invention is to provide accurate alignment of knitting needles and knitting guides.

Another advantage of this invention is to reduce the time required for aligning knitting needles and knitting guides.

These and other advantages will be in part apparent and in part pointed out below.

BRIEF DESCRIPTION OF THE DRAWINGS

The above, as well as other objects of the invention, will become more apparent from the following detailed description of the preferred embodiments of the invention when taken together with the accompanying drawings, in which:

FIG. 7 is a flow chart of the initialization steps for a knitting needle and knitting guide alignment tool of the present invention; and FIG. 8 is a continuation of the flow chart of FIG. 7, which describes the main loop of the software program for aligning knitting needles and knitting guides incorporating the novel features of the present invention.

Corresponding reference characters indicate corresponding parts throughout the separate views of the drawings.

DETAILED DESCRIPTION OF THE PREFERRED EMBODIMENT

Figure 1:
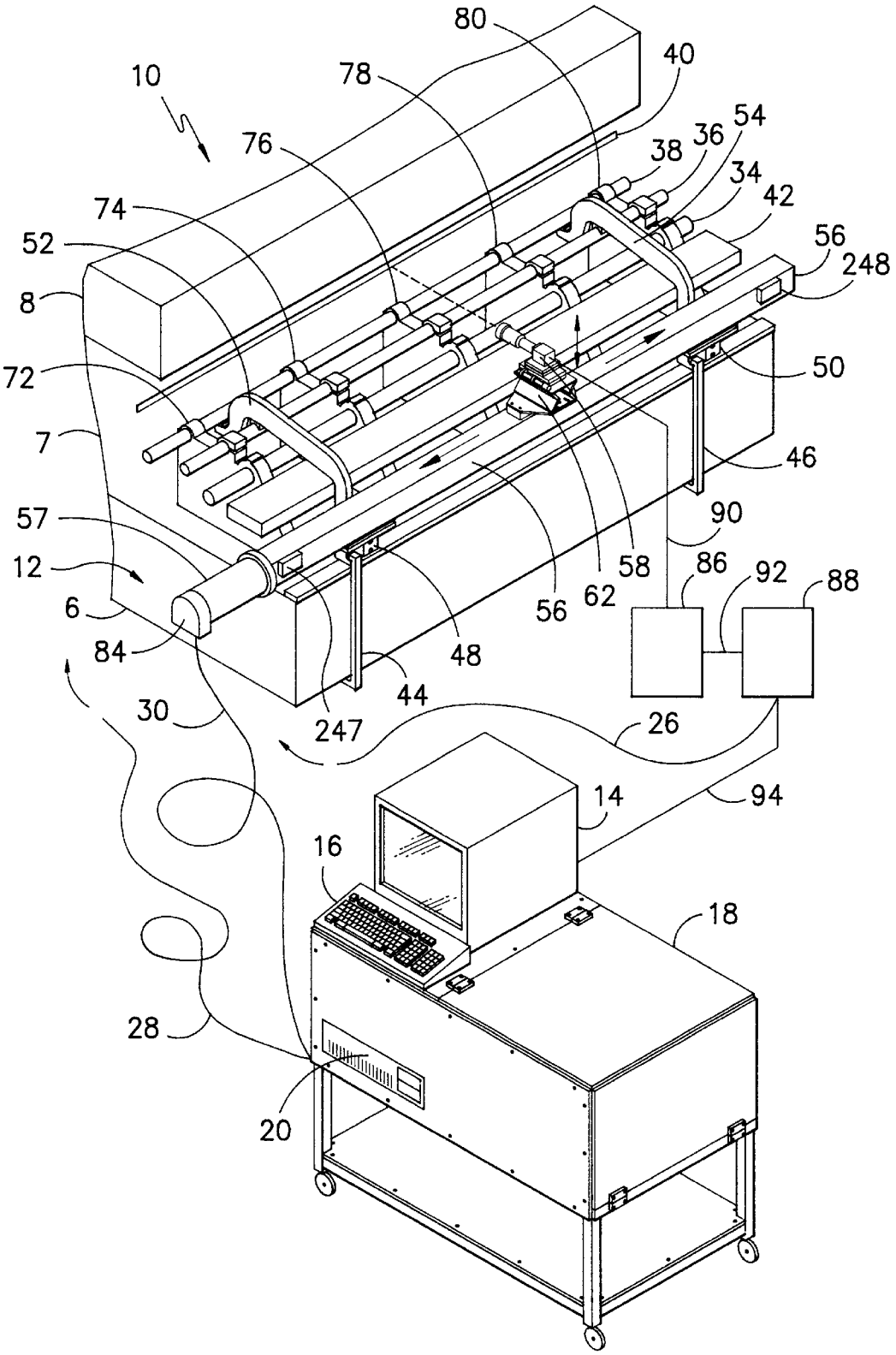
FIG. 1 is a perspective view of an apparatus for aligning knitting needles and knitting guides incorporating the novel features of the present invention along with a view of the right side of a warp knitting machine in conjunction with a computer, monitor, and keyboard on an electronics cart.

Referring now to the accompanying drawings, initially to FIG. 1, which is a perspective view of the right side of a typical warp knitting machine and the knitting needle and alignment apparatus of the present invention. This combination is generally denoted by numeral 10. The warp knitting machine is specifically denoted by numeral 12. A typical nonlimiting example of a warp knitting machine includes a LIBA®, Model Number BG-506-DPLM, Model Number DG-508-DPLM, and Model Number RACOP-D8-MK-DPLM. LIBA® warp knitting machines are manufactured by LIBA Maschinenfabrik, GmbH, located at D95112 Naila-Oberklingensporn, Germany. Referring now to both FIGS. 1 and 2, warp knitting machine 12 includes a rectangular base member 6 in the center of which is a vertical support beam 7 having a rectangular top member 8 attached thereto that is parallel to the rectangular base member 6. In FIG. 1, on the right hand side of the warp knitting machine 12, there are a series of five rotatable shaft support brackets designated by numerals 72, 74, 76, 78, and 80, respectively. These five rotatable shaft support brackets 72, 74, 76, 78, and 80, are equally spaced and extend from the left to right. Rotatable shaft support brackets 72, 74, 76, 78, and 80 are perpendicularly attached to the rectangular base member 6 and vertically extend upward. These five rotatable shaft support brackets 72, 74, 76, 78, and 80 hold rotatable shafts 34, 36, 38 in a position parallel to the base member 6. A first row of knitting needles is designated by numeral 40 and is positioned parallel and behind the three rotatable shafts 34, 36, 38 and just below the top rectangular member 7. Positioned parallel to and in front of the three rotatable shafts 34, 36, and 38 is a first arm rest for mechanics designated by numeral 42.

Figure 2:
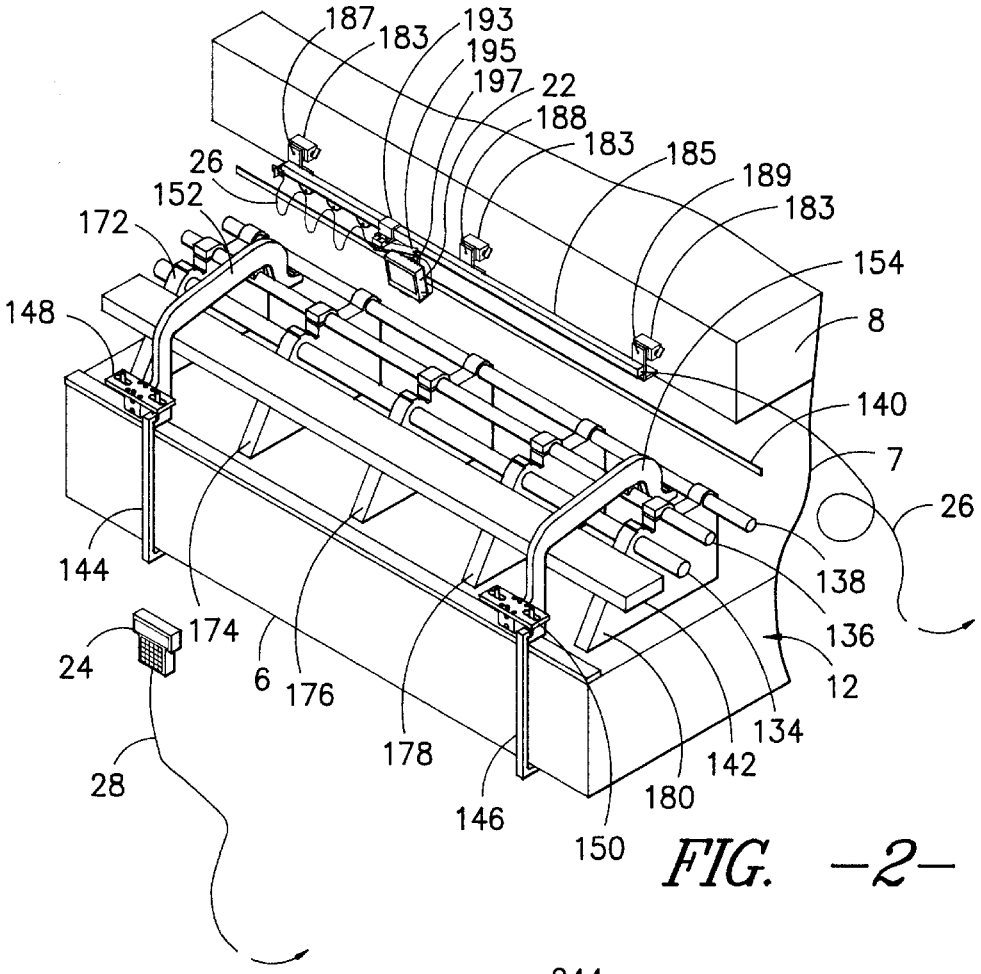
FIG. 2 is an perspective view of the left hand side of a knitting machine including a viewing screen and a digital keypad.

As shown in FIG. 2, this is duplicated on the left side of the knitting machine 12 with an additional series of three rotatable shafts 134, 136, and 138. These three rotatable shafts 134, 136, and 138 are also supported by five rotatable shaft support brackets with the numeral designations of 172, 174, 176, 178, and 180. These five rotatable shaft support brackets 172, 174, 176, 178, and 180 are equally spaced and extend from left to right. There is also a second arm rest for mechanics 142 positioned in front of the three rotatable shafts 134, 136, and 138, as well as a second row of knitting needles 140 positioned parallel and behind the three rotatable shafts 134, 136, 138 and just below the top rectangular member 7.

Figure 4:
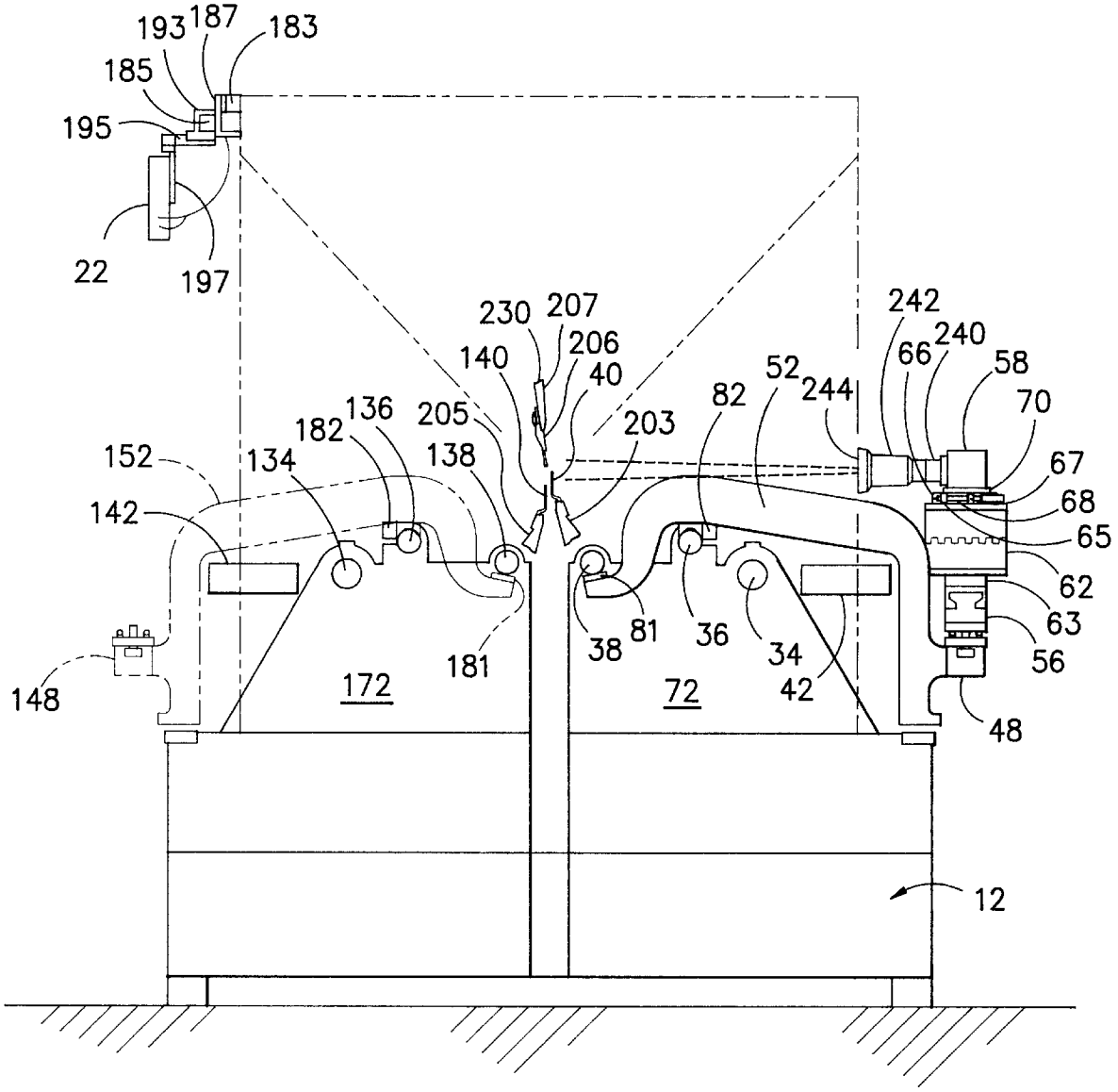
FIG. 4 is an isolated side elevational view of a knitting machine including the novel knitting needle and knitting guide alignment mechanism incorporating the novel features of the present invention including video camera, linear actuator, locating arm, and viewing screen.

Referring again to FIG. 1, there is a linear actuator 56 that is removedly attached to the knitting machine 12 by a pair of mounting brackets 48 and 50, respectively. Mounting bracket 48 is attached to the base member 6 of the knitting machine 12 by means of clamp 44. Mounting bracket 50 is attached to the base member 6 of the knitting machine 12 by means of clamp 46. The linear actuator 56 is stabilized by means of two locating arms 52 and 54, respectively. Locating arm 52 goes over rotating shafts 34 and 36 and rests underneath rotating shaft 38. As shown in FIG. 4, there is a hardened steel pad 81 attached to locating arm 52 that is in contact with rotating shaft 38. There is a hardened steel V-block 82 that rests over rotating shaft 36 at its position underneath locating arm 52. This is replicated for locating arm 54 with a similar hardened steel pad and hardened steel V-block (not shown).

As shown in FIG. 2, this same structure is replicated on the left hand side of warp knitting machine 12 with mounting brackets 148 and 150. The linear actuator 56 can be moved to this side and attached thereto. There is again a pair of clamps 144 and 146 for attaching the mounting brackets 148 and 150 to the warp knitting machine 12. There is also a pair of locating arms 152 and 154 attached to mounting brackets 148 and 150, respectively. Locating arm 152 goes over the second arm rest for the mechanic 142 and rotating shafts 134 and 136 while positioned against rotating shaft 138. As again shown in FIG. 4, there is a hardened steel pad 181 located between locating arm 152 and rotating shaft 138. There is a hardened V-block 182 positioned over rotating shaft 136 and underneath locating arm 152. This is replicated for locating arm 154 with a similar hardened steel pad and hardened steel V-block (not shown).

Figure 3:
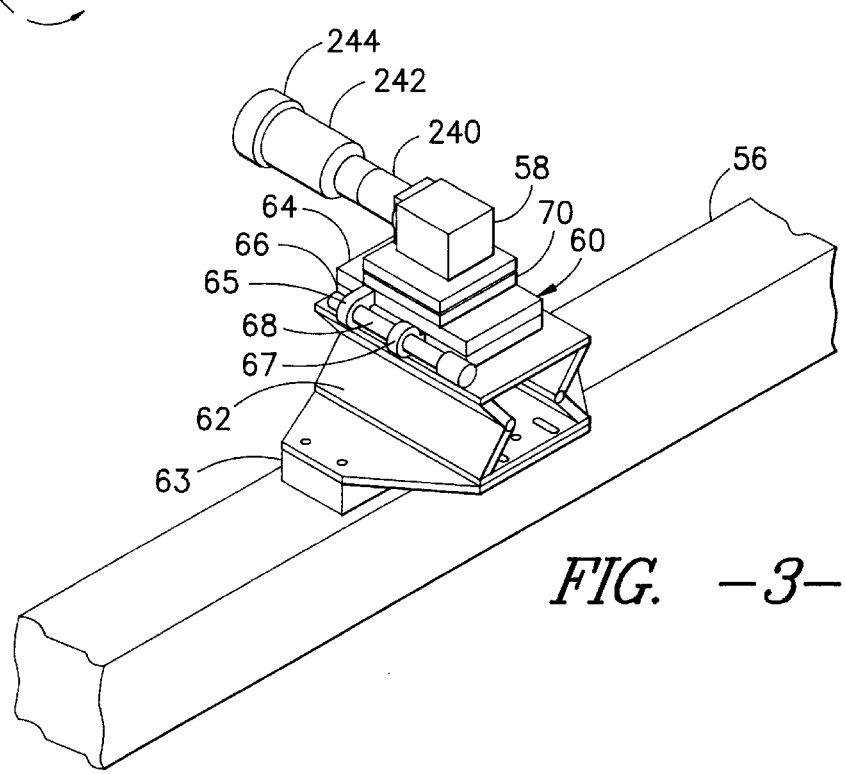
FIG. 3 is an isolated perspective view of the video camera, mounting means for the video camera, and a linear actuator.

A central component is the utilization of a video camera 58 as shown in FIGS. 1, 3, and 4 that is able to move back and forth in a direction parallel to and along the length of the first row of knitting needles 40 if the linear actuator 56 is attached to mounting brackets 48 and 50 or in a direction parallel to and along the length of the second row of knitting needles 140 if the linear actuator 56 is attached to mounting brackets 148 and 150.

A typical nonlimiting example of the video camera 58 would be a PULNIX, Model Number TM7CN manufactured by Pulnix America, Inc., located at 1330 Orleans Drive, Sunnyvale, Calif. 94089. The image in the video camera 58 is enlarged by means of a 2X extender 242. This 2X extender 242 functions as a magnifier so that the image produced by video camera 58 will be literally doubled. A nonlimiting example of a 2X extender is FUJINON® CE2O-1 MODEL V2.OX PROD 1486 manufactured by Fuijinon, Inc., located at Ten High Point Drive, Wayne N.J. 07470. A lens 244 is attached to the 2X extender 242. A typical nonlimiting example of a lens would be a Computer MCA7518APC 75 millimeter F1.8 TV lens manufactured by Chugai Boyeki America, located at 55 Mall Drive, Commack, N.Y. 11775. As shown in FIGS. 3 and 4, located between the video camera 58 and the 2X extender 242 is an extension tube 240. A typical nonlimiting example of an extension tube is FUJINON®, Model VETK PROD 0826 manufactured by Fuijinon, Inc., located at Ten High Point Drive, Wayne N.J. 07470. The utilization of an extension tube and extender can vary depending on the needle size, the spacing of the needles, and the other parameters of the warp knitting machine 12.

Two additional hardware elements that prove helpful include a grid 88 that is superimposed on the video camera image and an image invertor 86. All of these components are hardware devices that alter the video image. A typical non-limiting example of a grid 88 would be a JAVELIN MODEL JV2000GRD manufactured by Javelin Electronics, located at 19831 Magellan Drive, Torrance, Calif. 90502. A typical nonlimiting example of an image invertor 86 would include an AD DIGIFLIP, Model AD1426 SN 319714 manufactured by American Dynamics, located at 10 Corporate Drive, Orangeburg, N.Y. 10962. The image invertor 86 rotates the video image by one hundred and eighty degrees. The grid 88 places a specified number of intersecting vertical and horizontal lines over the video image. This essentially functions as template for aligning knitting needles and guides. As shown in FIG. 1, there is a first video cable 90 that connects the video camera 58 to the invertor 86. A second video cable 92 connects the invertor 86 to the grid 88. There is a fourth video cable 94 that is connected to a video monitor 14.

As shown in FIG. 3, a video camera 58 is mounted on video camera support block 70. Video camera support block 70 is mounted on a horizontal adjustable mechanism as generally denoted by numeral 60. Horizontal adjustable mechanism 60 includes a top plate 64 overlapping a bottom plate 66. Top plate 64 has a threaded member 65 and bottom plate 66 has a threaded member 67. There is an adjustment bolt 68 extending between threaded member 65 and threaded member 67 to provide horizontal adjustment for the video camera 58. This horizontal adjustable mechanism 60 can also be termed a kinematic base. A typical nonlimiting example of a kinematic base is Model M-BK-3, manufactured by Newport Corporation located at 1791 Deere Avenue, Irvine, Calif. 92714.

Bottom plate 66 is mounted on an orthogonal hinge jack 62 for vertical adjustment. A typical nonlimiting example of a orthogonal hinge jack 62 for vertical adjustment is manufactured by Newport Corporation located at 1791 Deere Avenue, Irvine, Calif. 92714., Model M-270.

The orthogonal hinge jack 62 is mounted on a support saddle 63. The support saddle 63 moves on top of a linear actuator 56. This allows the video camera 58 to traverse the full length of the knitting machine 12. Linear actuator 56 includes a ball screw (not shown) that is rotated by a stepper motor 57. There is a ball nut (not shown) that rides on top of the ball screw along the length of the knitting machine 12. There are a series of ball bearings (not shown) in between the ball screw and the ball nut. The carriage saddle 63 is fixedly attached to the ball nut. There is also an encoder 84 for accurately determining the position of the carriage saddle 63. A typical nonlimiting example of a stepper motor 57 is manufactured by Warner Electric Model SS2000-06. A typical nonlimiting example of a stepper motor 57 with encoder 84 is Warner Electric Model M093-FF206-CS. A typical example of a carriage manufactured by Warner Electric is Model RAPIDTRAK TS09. Warner Electric is located at 449 Gardner Street, South Beloit, Ill. 61080.

As shown in FIG. 1, there is a first electrical cable 30 that connects the stepper motor 57 and the linear actuator 56 to a computer 20. Computer 20 can be any of a wide variety of commercially available microprocessors. A typical nonlimiting example would be a GATEWAY® 20 MHZ 386SX computer, although there are advanced 486 and PENTIUM® Models that would be preferred. PENTIUM® is a registered trademark of the Intel Corporation located at 3065 Bowers Avenue, Santa Clara, Calif. 95054. GATEWAY® computers are manufactured by Gateway 2000, located at 610 Gateway Drive, North Sioux City, S.Dak. 57049. Computer 20 is located on electronics cart 18. Also positioned on the electronics cart 18 is a keyboard 16 and the video monitor 14. A typical nonlimiting example of a keyboard 16 would be Industrial Computer Source Model DI016, manufactured by Industrial Computer Source, located at 10180 Scripps Ranch Boulevard, San Diego, Calif. 92131. A typical nonlimiting example of a video monitor 14 would be a Mitsubishi Model HL6605TK manufactured by Mitsubishi Electronics America, Incorporated located at 991 Knox Street, Torrance, Calif. 90502. The computer 20 would have to actuate a motor controller (not shown), which is a board that is a part of the computer 20. A typical nonlimiting example of a motor controller is B & B Motors and Controllers Model PC-DSP-100, manufactured by B & B Motors and Controllers, located at Apple Hill Commons, Burlington, Conn. 06013. Instead of using the keyboard 16, the actuator 56 may also be controlled by a hand held programmable key pad 24. As shown in FIG.2, a programmable key pad 24 is attached by a second electrical cable 28 to the computer 20.

As shown in FIGS. 2 and 4, a liquid crystal diode monitor 22 is attached to an attachment bracket 197 which is pivotally attached to a support bracket 195 that is also pivotally attached to a linear slide 193. A typical nonlimiting example of a liquid crystal diode monitor 22 would be a Sharp Model 6M-40U manufactured by Sharp Electronics Corporation, located at Sharp Plaza, Mahwah, N.J. 07430. Linear slide 193 can move back and forth across a linear rectangular slide 185. Linear slide 185 is held against knitting machine 12 by means of a series of three switchable magnets 183. These magnets 183 can be turned off or on to enable the operator to move this liquid crystal diode monitor 22 to either side of the knitting machine 12. There are a series of three brackets 187, 188, and 189, respectively, that connect the linear rectangular slide 185 to the series of three switchable magnets 183. This liquid crystal diode monitor 22 is attached to grid 88 by means of a fourth video cable 26. As previously stated, grid 88 is attached to invertor 86 by means of second video cable 92 and invertor 86 is attached to video camera 58 by means of first video cable 90, as shown in FIG. 1.

Figure 5:
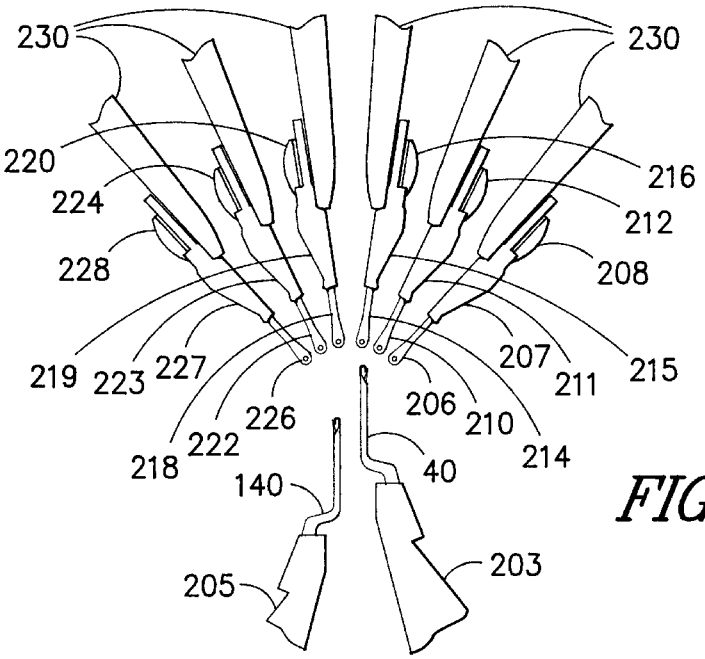
FIG. 5 is an isolated side view of the knitting mechanism, including double needles and the six guide members located above in an arc-like configuration.
Figure 6:
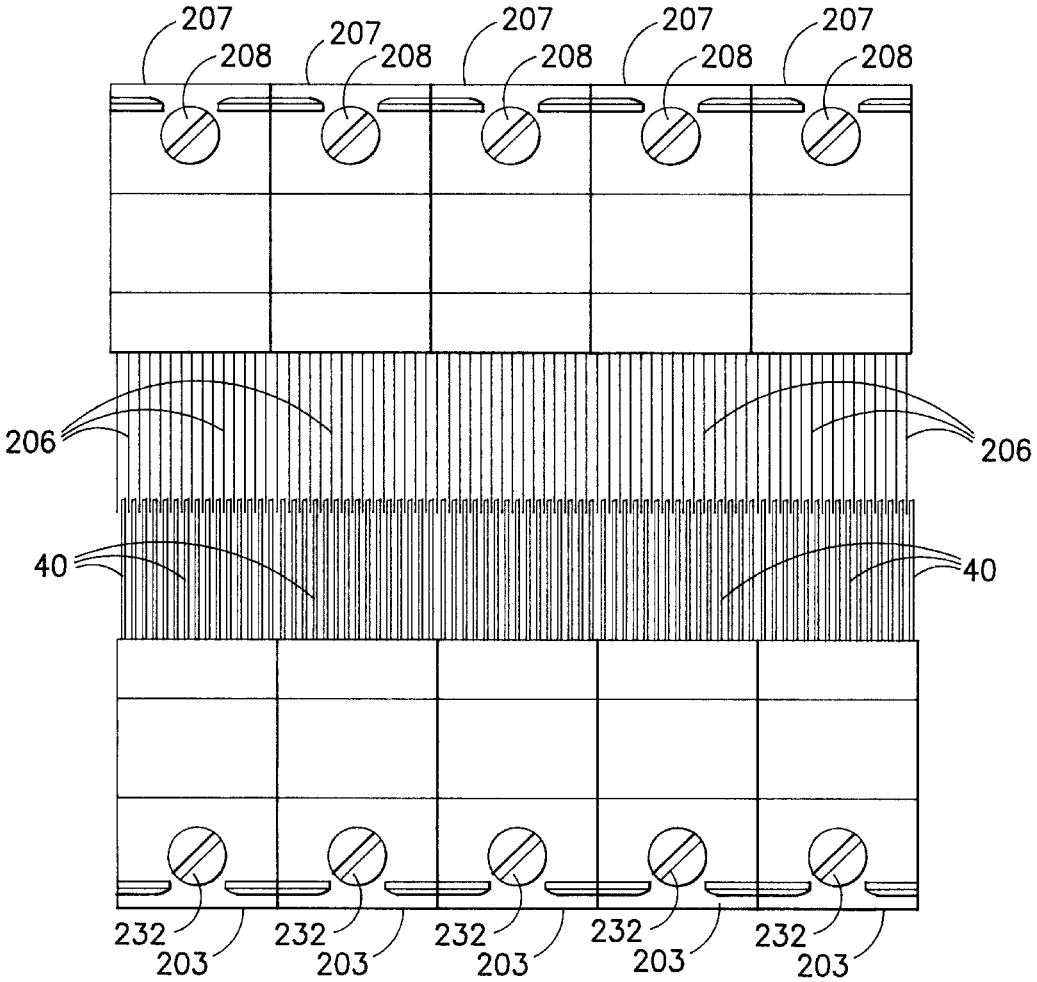
FIG. 6 is a front isolated view of a series of knitting needles and one series of knitting guides.

The knitting machine 12 is set up as a double bar knitting machine, as shown in FIG. 5. There is a first row of knitting needles 40 and a second row of knitting needles 140 that alternate up and down along the Z axis. The first row of knitting needles 40 is attached to the knitting machine 12 by a series of caps and trick plates 203. The second row of knitting needles 140 is attached to knitting machine 12 by a second row of caps and trick plates 205. As shown in FIG. 5, for each pair of knitting needles 40 and 140, respectively, a series of six rows of guides interact therewith that are denoted as guides 206, 210, 214, 218, 222, and 226, respectively. As shown in FIGS. 5 and 6, the row of guides designated by numeral 206 are attached to a row of molded guide support bases 207. These molded guide support bases 207 are attached to the guide bar assembly 230 by means of a first row of attachment screws 208. The second row of guides 210 is attached to a second row of molded guide support bases 211. These molded guide support bases 211 are attached to the guide bar assembly 230 by means of a second row of attachment screws 212. The third row of guides 214 are connected to a third row of molded guide support bases 215. The third row of molded guide support bases 215 are attached to the guide bar assembly 230 by means of a third row of attachment screws 216. A fourth row of guides 218 is attached to the fourth row of molded guide support bases 219. The fourth row of molded guide support bases is attached to the guide bar assembly 230 by means of a fourth row of attachment screws 220. The fifth row of guides 222 is connected to a fifth row of molded guide support bases 223. The fifth row of molded guide support bases 223 is attached to the guide bar assembly 230 by means of a fifth row of attachment screws 224. Finally, the sixth row of guides 226 is connected to a sixth row of molded guide support bases 227. The sixth row of molded guide support bases 227 is attached to the guide bar assembly 230 by means of a sixth row of attachment screws 228. The guide bar assembly 230 can rock as well as move back and forth. In other words, the guide bar assemble can move along the x, y, and z axis.

Referring again to FIG. 6, the first row of guides 206 is shown in the upper position located between the first row of knitting needles 40 extending from the bottom. The first row of guides 206 are attached to a first row of molded guide support bases 207 and fixedly attached to the guide bar assembly 230 by means of a first row of attachment screws 208. The first row of knitting needles 40 are attached to a first row of knitting needle caps and trick plates 203 by means of a series of a first row of knitting needle attachment screws 232. The goal is to align the row of knitting needles 40 first. This involves adjusting the needles 40 until they are properly and equally spaced, vertical, and all the same height. The gauge of the needles 40 ranges from 16 to 28 needles per inch. Once the needles 40 are aligned, the first row of guides 206 are lowered into the gaps between the needles 40. The interference typically ranges from one-eighth (⅛) to one-fourth (¼) of an inch and depends on the geometry of the needles and guides as well as the style of the fabric to be knitted. The guides 206 are then adjusted so that they equally split the distance between two adjacent needles. The guides 206 must also be adjusted so that they are the same and proper height. In addition, back-to-front needle and guide alignment will also have to be ascertained. Once the guides 206 have been aligned, the guides 206 are removed from the guide bar assembly 230, and the next row of guides 210 are aligned in a similar fashion. This procedure continues for guides 214, 218, 222, and 226. The second row of needles 140 are aligned and the guides 206, 210, 214, 218, 222, and 226 are again checked for alignment with the second row of needles 140.

FIG. 7 details a flow chart of the initialization process for the computer program. The first step is the initialization of the hardware (Block 310). The next step is run the video grid setup (Block 312) which receives the input for the chosen grid size (Block 314). The next step is to establish a set-up menu (Block 316). This involves receiving user input (Block 324). This input involves providing the needle gauge (Block 318), as well as the microstep size which is a predetermined amount of movement of the video camera (Block 320) as well as an increment size (Block 322) which is for moving a certain number of knitting needles per increment. The next step is to wait for input (Block 328) from the "Go To Home Limit" key (Block 326). This will let the camera 58 go to the first limit switch 247 nearest the stepper motor 57 on the left end of the linear actuator 56, as shown in FIG. 1 (Block 330). There is a second limit switch 248 on the far right end of the linear actuator 56. The camera 58 will continue to move down the linear actuator 56 until the first limit switch 247 is activated. The computer software will continue looping until an input is received that the home needle is found, which can be an arbitrary needle selected by the operator (Blocks 332 and 334). After the home needle is found (Block 338), the operator can push the "Set Home Needle" button (Block 336) to initialize the program and provide input to the computer as to the position of the home needle. Initialization is now complete and the system is ready for utilization.

The main body of the computer program is flowcharted in FIG. 8. The first step is to start the main loop (Block 340). There is a "Wait Until a Key is Hit" (Block 344) that requires the striking of the desired key (Block 342) then reading the ASCII code of that key (Block 346). There are fourteen different functions possible, or in other words, fourteen different keys that can be pushed. The first function is to move the camera 58 in a positive direction until it strikes the first limit switch 247 (Block 348). The second function is to move the camera 58 in a negative direction until it strikes the second limit switch 248 (Block 350). The third function is to toggle the camera 58 in either the positive or negative direction (Block 352). The fourth function is to move the camera 58 in the negative direction the distance of one knitting needle (Block 354). The fifth function is to move the camera 58 in the positive direction the distance of one knitting needle (Block 356). The sixth function is to move the camera 58 by a microstep in a positive direction (Block 358) and the seventh function is to move the camera 58 by a microstep in a negative direction (Block 360). A microstep is defined by taking a previously inputted number and dividing that number by one thousand. This number was provided in the step indicated by Block 320 in FIG. 7. The eighth and ninth functions are respectively, moving by a certain number of needles in the negative direction (Block 362) depending upon your previously inputted increment size found in (Block 322) or moving by a certain number of needles in the positive direction (Block 364). You can move a negative number of needles (Block 362) or positive number of needles (Block 364).

The tenth function is positive jogging (Block 366), which will occur until either the end of travel is reached with the activation of limit switch 247 or the emergency stop button is pushed or the jog button is pushed again which acts to quit the jogging process (Blocks 370 and 372). This then stops the jogging process (Block 374). The computer then loops back to Block 344 and starts over again.

The eleventh function is negative jogging (Block 368), which will occur until either the end of travel is reached with the activation of limit switch 247 or the emergency stop button is pushed or the jog button is pushed again which acts to quit the jogging process (Blocks 370 and 372). This then stops the jogging process (Block 374). The computer then loops back to Block 344 and starts over again.

The twelfth function (Block 376) is repeating the set-up routine found in FIG. 7 in Blocks 322, 320, and 318. This involves receiving input (Block 378) involving a new needle gauge (Block 384), a new microstep size (Block 382), and a new increment size (Block 380). The computer then loops back to Block 344 and starts over again allowing the operator to use thirteen other functions with these new input parameters.

The thirteenth function (Block 386) is similar to that found in the initialization portion of the program (FIG. 7) is going to the home needle. This is identical similar to routine found in Blocks 332, 334, 338, and 336, as previously described. The camera 58 will move along the linear actuator 56 until the desired knitting needle is directly in the middle of the video image. This involves looping through Blocks 388 and 390. When the home needle is found (Block 394), the home needle key can be reset (Block 392). The computer then loops back to Block 344 and starts over again.

The last and fourteenth function is to stop all motion (Block 396) and end the program (Block 398).

As this invention may be embodied in several forms without departing from the spirit or essential character thereof, the embodiments presented herein are intended to be illustrative and not descriptive. The scope of the invention is intended to be defined by the following appended claims, rather than any descriptive matter hereinabove, and all embodiments of the invention which fall within the meaning and range of equivalency of such claims are, therefore, intended to be embraced by such claims.

What is claimed is:

1. An apparatus for knitting needle and knitting guide alignment, which comprises:

(a) a linear actuator having a longitudinal axis;

(b) a means for receiving a video image of knitting needles and knitting guides;

(c) a means for attaching said means for receiving a video image to said linear actuator;

(d) a means for selectively activating said linear actuator thereby moving said means for receiving a video image along said longitudinal axis of said linear actuator; and (e) a means for displaying said video image;

wherein said means for receiving a video image of knitting needles and knitting guides includes includes a video camera and an image invertor.

2. An apparatus for knitting needle and knitting guide alignment, which comprises:

(a) a linear actuator having a longitudinal axis;

(b) a means for receiving a video image of knitting needles and knitting guides;

(c) a means for attaching said means for receiving a video image to said linear actuator;

(d) a means for selectively activating said linear actuator thereby moving said means for receiving a video image along said longitudinal axis of said linear actuator; and (e) a means for displaying said video image;

wherein said means for receiving a video image of knitting needles and knitting guides includes a video camera and a grid.

3. An apparatus for knitting needle and knitting guide alignment as defined in claim 2, wherein said means for receiving a video image of knitting needles and knitting guides includes an image invertor.

4. An apparatus for knitting needle and knitting guide alignment, which comprises:

(a) a linear actuator having a longitudinal axis;

(b) a means for receiving a video image of knitting needles and knitting guides, which includes a video camera having a lens attached thereto;

(c) a means for attaching said means for receiving a video image to said linear actuator;

(d) a means for selectively activating said linear actuator thereby moving said means for receiving a video image along said longitudinal axis of aid linear actuator; and (e)a means for displaying said video image;

wherein said means for receiving a video image of knitting needles and knitting guides includes a magnifier positioned between said video camera and said lens.

5. An apparatus for knitting needle and knitting guide alignment as defined in claim 4, further comprising an extension tube and a magnifier positioned between said video camera and said lens.

6. An apparatus for knitting needle and knitting guide alignment, which comprises:

(a) a linear actuator having a longitudinal axis;

(b) a means for receiving a video image of knitting needles and knitting guides;

(c) a means for attaching said means for receiving a video image to said linear actuator, said means for attaching including a kinematic base;

(d) a means for selectively activating said linear actuator thereby moving said means for receiving a video image along said longitudinal axis of said linear actuator; and (e) a means for displaying said video image; wherein said means for attaching said video image-receiving means to said linear actuator includes a kinematic base.

7. An apparatus for knitting needle and knitting guide alignment as defined in claim 6, wherein said means for attaching said video image-receiving means to said linear actuator includes a top plate having a first threaded member attached thereto and a bottom plate having a second threaded member attached thereto and an adjustment bolt extending between said first threaded member and said second threaded member for horizontal adjustment of said video camera.

8. An apparatus for knitting needle and knitting guide alignment as defined in claim 6, wherein said means for attaching said video image-receiving means to said linear actuator includes an orthogonal hinge jack for vertical adjustment of said video camera.

9. An apparatus for knitting needle and knitting guide alignment as defined in claim 6, wherein said means for attaching said video image-receiving means to said linear actuator includes a top plate having a first threaded member attached thereto and a bottom plate having a second threaded member attached thereto and an adjustment bolt extending between said first threaded member and said second threaded member whereby said top plate is attached to said video image-receiving means and said bottom plate is attached to an orthogonal hinge jack having a top portion and a bottom portion whereby said bottom plate is attached to said top portion of said orthogonal hinge jack and said bottom portion of said orthogonal hinge jack is attached to said linear actuator.

10. An apparatus for knitting needle and knitting guide alignment, which comprises:

(a) a linear actuator having a longitudinal axis;

(b) a means for receiving a video image of knitting needles and knitting guides;

(c) a means for attaching said means for receiving a video image to said linear actuator;

(d) a means for attaching said linear actuator to a warp knitting machine;

(e) a means for selectively activating said linear actuator thereby moving said means for receiving a video image along said longitudinal axis of said linear actuator; and (f) a means for displaying said video image;

wherein said means for attaching said linear actuator to a warp knitting machine includes a mounting bracket attached to said linear actuator and a clamp having a first portion and a second portion wherein said first portion is attached to said mounting bracket and said second portion is attached to said warp knitting machine.

11. An apparatus for knitting needle and knitting guide alignment as defined in claim 10, further comprising of at least one support arm attached to said mounting bracket and said warp knitting machine.

12. An apparatus for knitting needle and knitting guide alignment as defined in claim 11, wherein said support arm includes a pad.

13. An apparatus for knitting needle and knitting guide alignment as defined in claim 11, wherein said support arm includes a V-block.

14. An apparatus for knitting needle and knitting guide alignment as defined in claim 11, wherein said support arm includes a pad and V-block.

15. An apparatus for knitting needle and knitting guide alignment, which comprises:

(a) linear actuator having a longitudinal axis;

(b) a means for receiving a video image of knitting needles and knitting guides;

(c) a means for attaching said means for receiving a video image to said linear actuator;

(d) a means for attaching said linear actuator to a warp knitting machine;

(e) a means for selectively activating said linear actuator thereby moving said means for receiving a video image along said longitudinal axis of said linear actuator; and (f) means for displaying a said video image;

wherein said means for attaching said linear actuator to a warp knitting machine includes a plurality of mounting brackets attached to said linear actuator and a plurality of clamps each having a first portion and a second portion wherein each said first portion is attached to each said mounting bracket and each said second portion is attached to said warp knitting machine.

* * * * *